US006978029B1

(12) United States Patent
Ikeda

(10) Patent No.: US 6,978,029 B1
(45) Date of Patent: Dec. 20, 2005

(54) CONDENSER MICROPHONE APPARATUS AND ITS CONNECTING APPARATUS

(75) Inventor: Masaharu Ikeda, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 552 days.

(21) Appl. No.: 09/612,254

(22) Filed: Jul. 7, 2000

(30) Foreign Application Priority Data

Jul. 8, 1999 (JP) ..... 11-194016

(51) Int. Cl.[7] ..... H04R 3/00
(52) U.S. Cl. ..... 381/111; 381/191
(58) Field of Search ..... 381/111, 113, 112, 381/174, 150, 369, 191, 114, 120, 92

(56) References Cited

U.S. PATENT DOCUMENTS 3,944,756 A * 3/1976 Lininger ..... 381/111
4,525,817 A * 6/1985 Takuya ..... 367/140
5,097,515 A * 3/1992 Baba ..... 381/150
5,197,102 A * 3/1993 Sondermeyer ..... 381/96
5,579,397 A * 11/1996 Ikeda et al. ..... 381/113
5,588,065 A * 12/1996 Tanaka et al. ..... 381/96
5,635,670 A * 6/1997 Kubota et al. ..... 174/52.1
6,104,818 A * 8/2000 Korner ..... 381/113
6,504,937 B1 * 1/2003 Papadopoulos ..... 381/113

FOREIGN PATENT DOCUMENTS

EP 0670602 A1 9/1995
EP 0800331 A2 10/1997

* cited by examiner

*Primary Examiner*—Vivian Chin
*Assistant Examiner*—Lun-See Lao
(74) *Attorney, Agent, or Firm*—Stevens, Davis, Miller & Mosher, LLP

(57) ABSTRACT

A condenser microphone apparatus which is used for a radio apparatus in order to reduce noises generated due to radiation of a high frequency signal of a transmitting unit. A series resistor is provided between a bypass capacitor provided between a drain and a source of an FET and a microphone signal output transmission line in order to prevent a high frequency voltage from being increased due to a resonance of the bypass capacitor and microphone signal output transmission line. Thus, the noises due to the radiation of the high frequency signal can be reduced.

22 Claims, 6 Drawing Sheets

CONDENSER MICROPHONE APPARATUS AND ITS CONNECTING APPARATUS

BACKGROUND OF THE INVENTION

1. Field of the Invention

The invention relates to a condenser micro-phone apparatus for converting an acoustic vibration into an electric signal and, more particularly, to such an apparatus having an impedance converting device therein.

2. Description of the Related Art

Generally, a condenser microphone apparatus comprises a condenser microphone unit, a microphone signal output transmission line, a load resistor, a power source, and the like.

Hitherto, the condenser microphone apparatus has a problem such that when it is used in a cellular phone or the like, noises are generated due to radiation of a high frequency signal from a transmitting unit. For a countermeasure against such a problem, as a condenser microphone apparatus, a method whereby a bypass capacitor is provided between a source and a drain of an internal FET (field effect transistor) has been known.

First, a construction of a condenser microphone unit in the conventional condenser microphone apparatus will be described with reference to the drawings.

FIG. 1A is a cross sectional structural view of a conventional condenser microphone unit in which a bypass capacitor is provided between a source and a drain of an FET. In FIG. 1A, the condenser microphone unit comprises: a cotton 11 for preventing the dust from entering the microphone unit; a sound input hole 12; a metal casing 13 also serving as a shield; a movable electrode 14 which vibrated in response to an acoustic vibration; a movable electrode ring 15; a spacer 16; a fixed electrode 17; an insulator 18; an FET 19; a wiring circuit board 20; a bypass capacitor 21; a microphone signal output terminal 22; and a microphone common output terminal (ground terminal) 23.

The movable electrode 14, fixed electrode 17, and spacer 16 form a capacitor. Each of the movable electrode 14 and fixed electrode 17 is made of an electret material itself or an electret material itself is adhered to such an electrode and charges are accumulated on the surface of the electret material. The spacer 16 insulates the movable electrode 14 and fixed electrode 17. The movable electrode ring 15 supports the movable electrode 14. The insulator 18 supports the fixed electrode 17 while insulating it. The FET 19 buffer-amplifies a voltage that is generated in the capacitor comprising the movable electrode 14 and fixed electrode 17 and has a device (diode) for bias setting therein. The wiring circuit board 20 also seals a rear surface while wiring a circuit. The bypass capacitor 21 is a capacitor for bypassing a high frequency signal entering from the outside to a common output terminal.

FIG. 1B is a bottom view of the condenser microphone unit. Since it has a co-axial, the microphone signal output terminal 22 and microphone common output terminal 23 are concentrically arranged so as to be come into contact with each other even if the direction is not determined. There is another condenser microphone unit having pin terminals.

The operation of the conventional condenser microphone apparatus will now be described with reference to FIG. 2. FIG. 2 is a circuit diagram of the conventional condenser microphone apparatus.

A microphone signal output transmission line 31 is used for wiring on a mother board of an apparatus such as a cellular phone or the like. A decoupling capacitor 35 (a parasitic capacitor between layers of the microphone signal output transmission line 31 and a ground pattern is also included) is used to decrease the high frequency signal that is superimposed onto the microphone signal output transmission line 31. Similarly, a load resistor 32 and a power source 33 are arranged on the mother board of the apparatus such as a cellular phone or the like. The microphone signal output transmission line 31 is regarded to be connected to the ground in a high frequency manner at the decoupling capacitor 35 in terms of a circuit construction.

The high frequency signal is supplied to the microphone signal output terminal 22 through the microphone signal output transmission line 31 and applied to a drain of the FET 19. The high frequency signal is supplied to a gate of the FET through an electrostatic capacitance between the drain and gate of the FET 19, is AM-detected by a diode for biasing of the FET 19 or by a pn junction of a channel and the gate of the FET 19, generates a DC component, and is converted into noises in an audible band. In a high carrier frequency band of a radio apparatus, the microphone signal output transmission line 31 operates as an inductor and the bypass capacitor 21 operates as a serial circuit of an electrostatic capacitance and a parasitic inductance, so that a parallel resonance or a series resonance is caused at a specific frequency. For example, at a frequency of a series resonance due to the electrostatic capacitance and parasitic inductance of the bypass capacitor 21, since a voltage across the bypass capacitor 21 is small, a high frequency voltage that is applied to the drain of the FET 19 is small and no noise is generated at this frequency. On the other hand, a large resonance current flows at a series resonance frequency of the bypass capacitor 21 and microphone signal output transmission line 31. This is because an effective series resistance of the bypass capacitor 21 and microphone signal output transmission line 31 is very small. Therefore, the voltage across the bypass capacitor 21 increases, a high frequency voltage that is applied to the drain of the FET 19 is large, and large noises are generated from the condenser microphone apparatus even by a small amount of high frequency signal. As mentioned above, since a magnitude of the high frequency voltage that is applied to the drain of the FET 19 is largely changed depending on the frequency of the high frequency signal, it is difficult to keep such a frequency low in a wide band.

In the case where the condenser microphone apparatus with such a construction is used in a cellular phone or the like, an antenna and the condenser microphone apparatus are likely to be arranged at remote positions in terms of an apparatus construction. This is because it is necessary to arrange a handset at a position near the ear and arrange the condenser microphone apparatus to a position near the mouth and the antenna is arranged near the handset because a radiation efficiency is higher as the antenna is arranged at a position as high as possible. Further, a length of antenna is shortened due to a miniaturization of the apparatus and the realization of a high carrier frequency. In terms of the radiating characteristics of the antenna, the high frequency voltage is induced on the opposite side of the antenna and the high frequency voltage which is applied to the condenser microphone apparatus locating there is high. Also, a length of wiring is long and they are arranged so that the high frequency voltage is easily superimposed. Therefore, it is impossible to cope with such a situation merely by the bypass capacitor as a conventional countermeasure. Further, there is a cellular phone which is used by two frequency bands and it is necessary to take a counter-measure against the noises at a different frequency.

SUMMARY OF THE INVENTION

It is an object of the invention to provide a condenser microphone apparatus for reducing a noise output which is generated by a high frequency signal that is radiated or conducted from a transmitting unit of a radio apparatus as mentioned above and to provide a connecting apparatus of such a condenser microphone apparatus.

To accomplish the above object, according to a preferred aspect of the invention, there is provided a condenser microphone apparatus comprising: a movable electrode which vibrates by an acoustic vibration; a fixed electrode arranged so as to face the movable electrode; amplifying means for buffer-amplifying a voltage across the movable electrode and a voltage across the fixed electrode; a bypass capacitor in which one end is connected to a signal output terminal of the amplifying means and the other end is connected to a common output terminal of the amplifying means; and a series resistor in which one end is connected to the signal output terminal of the amplifying means and the other end is connected to a signal output of the apparatus. With this construction, there are effects such that a noise output due to a high frequency signal which is radiated or conducted from a transmitting unit of a radio apparatus can be reduced in a wide carrier frequency range and, further, a breakdown withstanding voltage of electrostatic discharge which is applied to a microphone signal output terminal can be increased.

According to another aspect of the invention, there is provided a condenser microphone apparatus comprising: a movable electrode which vibrates by an acoustic vibration; a fixed electrode arranged so as to face the movable electrode; amplifying means for buffer-amplifying a voltage across the movable electrode and a voltage across the fixed electrode; a bypass capacitor in which one end is connected to a signal output terminal of the amplifying means and the other end is connected to the common output terminal of the amplifying means; and a serial circuit of a blocking capacitor and a damping resistor in which one end is connected to the signal output terminal of the amplifying means and the other end is connected to a common output terminal of the amplifying means. With this construction, there is an effect such that a noise output due to a high frequency signal which is radiated or conducted from a transmitting unit of a radio apparatus can be reduced in a wide carrier frequency range.

According to still another aspect of the invention, there is provided a connecting apparatus which is connected to a condenser microphone unit comprising: a movable electrode which vibrates by an acoustic vibration; a fixed electrode arranged so as to face the movable electrode; amplifying means for buffer-amplifying a voltage across the movable electrode and a voltage across the fixed electrode; and a bypass capacitor in which one end is connected to a signal output terminal of the amplifying means and the other end is connected to a common output terminal of the amplifying means, wherein a series resistor in which one end is connected to the signal output terminal of the amplifying means and the other end is connected to a signal output of the apparatus is provided. With this construction, there are effects such that a noise output due to a high frequency signal which is radiated or conducted from a transmitting unit of a radio apparatus can be reduced in a wide carrier frequency range and, further, a breakdown withstanding voltage of electrostatic discharge which is applied to a microphone signal output terminal can be increased.

According to further another aspect of the invention, there is provided a connecting apparatus which is connected to a condenser microphone unit comprising: a movable electrode which vibrates by an acoustic vibration; a fixed electrode arranged so as to face the movable electrode; amplifying means for buffer-amplifying a voltage across the movable electrode and a voltage across the fixed electrode; and a bypass capacitor in which one end is connected to a signal output terminal of the amplifying means and the other end is connected to a common output terminal of the amplifying means, wherein a serial circuit of a blocking capacitor and a damping resistor in which one end is connected to the signal output terminal of the amplifying means and the other end is connected to the common output terminal of the amplifying means is provided. With this construction, there is an effect such that a noise output due to a high frequency signal which is radiated or conducted from a transmitting unit of a radio apparatus can be reduced in a wide carrier frequency range.

According to further another aspect of the invention, there is provided a connecting apparatus which is connected to a condenser microphone unit comprising: a movable electrode which vibrates by an acoustic vibration; a fixed electrode arranged so as to face the movable electrode; and amplifying means for buffer-amplifying a voltage across the movable electrode and a voltage across the fixed electrode, wherein the connecting apparatus further comprises a bypass capacitor in which one end is connected to a signal output terminal of the amplifying means and the other end is connected to a common output terminal of the amplifying means and a series resistor in which one end is connected to the signal output terminal of the amplifying means and the other end is connected to a signal output of the apparatus. With this construction, there are effects such that a noise output due to a high frequency signal which is radiated or conducted from a transmitting unit of a radio apparatus can be reduced in a wide carrier frequency range and, further, a breakdown withstanding voltage of electrostatic discharge which is applied to a microphone signal output terminal can be increased.

According to further another aspect of the invention, there is provided a connecting apparatus which is connected to a condenser microphone unit comprising: a movable electrode which vibrates by an acoustic vibration; a fixed electrode arranged so as to face the movable electrode; and amplifying means for buffer-amplifying a voltage across the movable electrode and a voltage across the fixed electrode, wherein the connecting apparatus further comprises a bypass capacitor in which one end is connected to a signal output terminal of the amplifying means and the other end is connected to a common output terminal of the amplifying means and a serial circuit of a blocking capacitor and a damping resistor in which one end is connected to the signal output terminal of the amplifying means and the other end is connected to the common output terminal of the amplifying means. With this construction, there is an effect such that a noise output due to a high frequency signal which is radiated or conducted from a transmitting unit of a radio apparatus can be reduced in a wide carrier frequency range.

The above and other objects and features of the present invention will become apparent from the following detailed description and the appended claims with reference to the accompanying drawings.

DETAILED DESCRIPTION OF THE EMBODIMENTS

Embodiments of the invention will now be described hereinbelow with reference to the drawings.

First Embodiment

Figure 2:
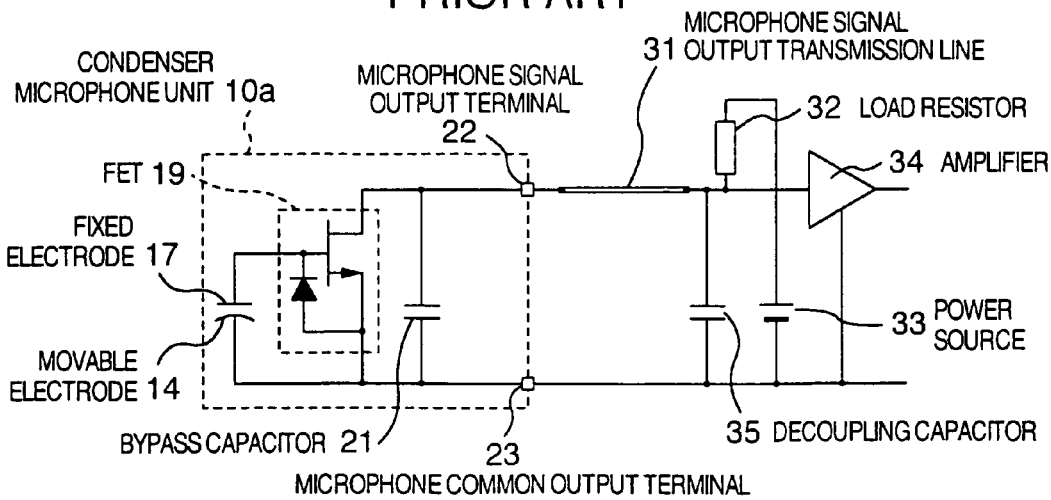
FIG.2 PRIOR ART
FIG. 2 is a circuit diagram showing the conventional condenser microphone apparatus.
Figure 3:
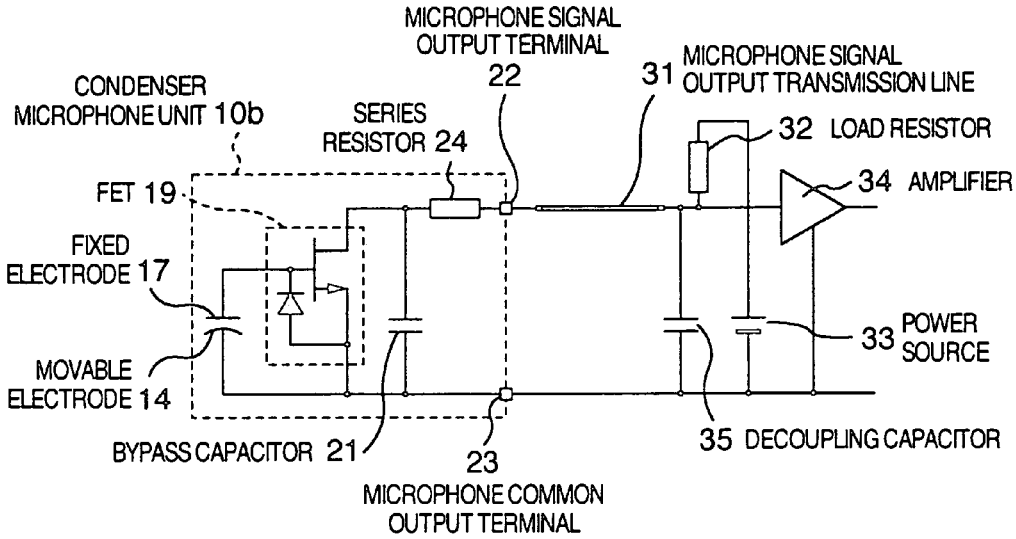
FIG. 3 is a circuit diagram of a condenser microphone apparatus comprising a condenser microphone unit in the first embodiment of the invention.

FIG. 3 is a circuit diagram of a condenser microphone apparatus in the first embodiment of the invention. FIG. 3 differs from the circuit diagram of the conventional condenser microphone apparatus shown in FIG. 2 with respect to a point that a series resistor 24 is added. In a condenser microphone unit 10*b* shown in FIG. 3, the series resistor 24 is inserted to an interval between the drain of the FET 19 and the microphone signal output terminal 22.

The series resistor 24 is provided to limit a resonance current and arranged in series with a series resonance circuit comprising the microphone signal output transmission line 31 and bypass capacitor 21 in terms of an equivalent circuit of a high frequency. Since an effective series resistance of the bypass capacitor 21 is equal to or less than 1Ω, by setting a resistance of the series resistor 24 to a value within a range from tens of Ω to hundreds of Ω, a resonance current of the microphone signal output transmission line 31 and bypass capacitor 21 can be reduced to a value within a range from 1/10 to 1/100. The high frequency voltage which is applied to the drain of the FET 19 can be also reduced to a value within a range from 1/10 to 1/100. Therefore, noises which are generated by the high frequency signal that is radiated or conducted from the transmitting unit of the radio apparatus can be suppressed. The series resistor 24 hardly exerts an influence on an acoustic signal converted into the electric signal from the acoustic vibration. The acoustic signal derived from the drain of the FET 19 can be regarded as a current source in terms of operating characteristics of the FET and this signal is converted into an acoustic signal voltage as a product of a signal current value and a load resistance value by the load resistor 32 (1 to 2 k Ω). Even if there is the series resistor 24 whose resistance has been set to the value within a range from tens of Ω to hundreds of Ω, since the value of the signal current that is outputted from the drain of the FET 19 hardly changes, an acoustic signal voltage developed across the load resistor 32 also hardly changes. The series resistor 24 further operates as a high band attenuating filter for attenuating the high frequency voltage superimposed to the microphone signal output transmission line 31 in cooperation with the bypass capacitor 21. For example, assuming that a capacitance of the bypass capacitor 21 is set to 33 pF and a resistance of the series resistor 24 is set to 100Ω, a cut-off frequency is equal to about 48 MHz and a frequency higher than this cut-off frequency is attenuated. On the other hand, since a carrier frequency of the cellular phone is equal to or higher than 800 MHz, the voltage across the bypass capacitor 21 can be reduced to 1/10 or less. Since the band of this filter is remarkably wider than the band due to a series resonance of the electrostatic capacitance and the parasitic inductance of the bypass capacitor 21, the noises can be reduced for the high frequency signal in a wider band.

Although the series resistor 24 is arranged in a casing of the condenser microphone unit 10*b* according to the condenser microphone apparatus of FIG. 3 in the first embodiment, even if it is arranged at another location, a similar effect is derived so long as electrical connecting conditions are satisfied. It is sufficient that one end of the series resistor 24 is connected to the drain of the FET 19 as a signal output terminal of amplifying means, the other end is connected to the signal output of the apparatus, and the series resistor 24 is arranged in series with the microphone signal output transmission line 31. For example, therefore, a similar effect is derived even if the series resistor 24 is arranged at an extremely near position on a circuit board of the cellular phone to which the condenser microphone unit 10*b* is connected. Such a modification and an effect are also similarly applied to the bypass capacitor 21.

Second Embodiment

Figure 4:
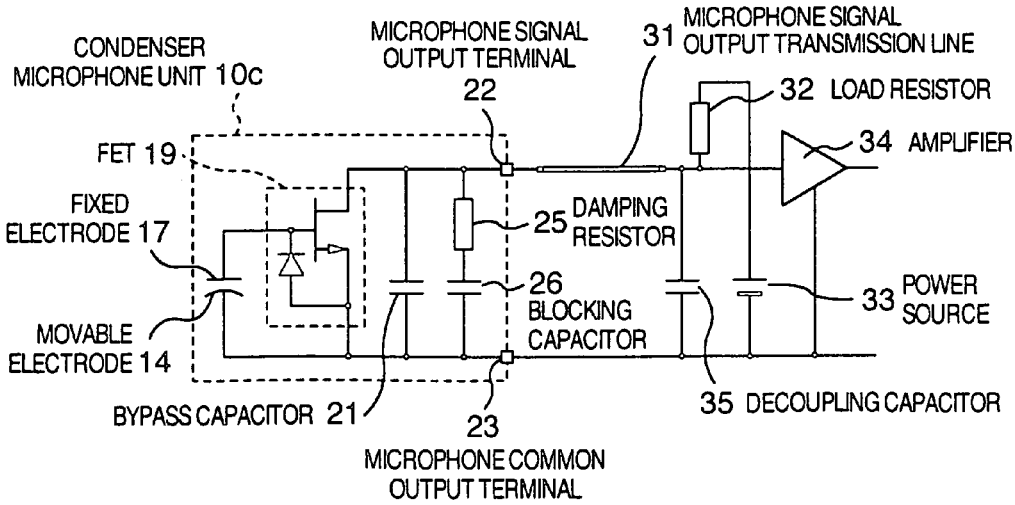
FIG. 4 is a circuit diagram of a condenser microphone apparatus comprising a condenser microphone unit in the second embodiment of the invention.

FIG. 4 is a circuit diagram of a condenser microphone apparatus in the second embodiment of the invention. FIG. 4 differs from the circuit diagram of the conventional condenser microphone apparatus shown in FIG. 2 with respect to a point that a damping resistor 25 and a blocking capacitor 26 are added. In a condenser microphone unit 10*c* shown in FIG. 4, the damping resistor 25 and the blocking capacitor 26 for blocking a direct current are serially connected and such a serial circuit is connected in parallel with the drain and source of the FET 19. The damping resistor 25 and blocking capacitor 26 are provided to damp a parallel resonance and arranged in parallel with the parallel resonance circuit comprising the microphone signal output transmission line 31 and bypass capacitor 21 in terms of an equivalent circuit of a high frequency. Since an effective series resistance of the bypass capacitor 21 is equal to or less than 1Ω, an impedance at the time of a parallel resonance of the microphone signal output transmission line 31 and bypass capacitor 21 is very large. For example, assuming a capacitance of the bypass capacitor 21 is equal to 33 pF and an inductance of the microphone signal output transmission line 31 is equal to 1.2 nH, a resonance frequency is equal to about 800 MHz and an impedance of the sole bypass capacitor 21 at that time is equal to about 6Ω. However, since a parallel resonance impedance including the inductance of the microphone signal output transmission line 31 is equal to a value within a range from about 40 to 80Ω, an attenuation amount of the high frequency signal is smaller than that of the sole bypass capacitor 21. However, by connecting the serial circuit comprising the damping resistor 25 and blocking capacitor 26 in parallel with the drain and source of the FET 19, the parallel resonance impedance can be reduced to a value close to the resistance value of the damping resistor 25, so that the high frequency voltage that is applied to the drain of the FET 19 can be finally reduced. A capacitance of the blocking capacitor 26 is set to an electrostatic capacitance value so as to prevent the DC bias voltage applied to the drain of the FET 19 and the acoustic signal from leaking to the microphone common output terminal 23 at a source potential of the FET 19 and to allow a high frequency signal current to flow promptly in the damping resistor 25. A resistance value of the damping resistor 25 is set to a value within a range from a few Ω to tens of Ω in terms of the relationship of the resonance impedance. By constructing as mentioned above, the noises which are generated due to a high frequency signal which is radiated or conducted from a transmitting unit of a radio apparatus can be suppressed. At a frequency that is equal to or higher than the cut-off frequency by the damping resistor 25 and blocking capacitor 26, an impedance parallel with the inductance of the bypass capacitor 21 and microphone signal output transmission line 31 is suppressed by the resistance value of the damping resistor 25. This value is wider than the band due to the series resonance of the electrostatic capacitance and the parasitic inductance of the bypass capacitor 21 and the noises can be reduced for the high frequency signal in a wider band.

According to the condenser microphone apparatus in FIG. 4 of the second embodiment, the damping resistor 25 and blocking capacitor 26 are arranged in a casing of the condenser microphone unit 10*c*. However, even if they are arranged at the other positions, a similar effect is derived so long as electrical connecting conditions are satisfied. It is sufficient that one end of the serial circuit of the damping resistor 25 and blocking capacitor 26 is connected to the drain of the FET 19 as a signal output terminal of the amplifying means and the other end is connected to the source of the FET 19 as a common output terminal of the amplifying means. For example, therefore, a similar effect is derived even if the damping resistor 25 and blocking capacitor 26 are arranged at an extremely near position on a circuit board of the cellular phone to which the condenser microphone unit 10*c* is connected. Such a modification and an effect are also similarly applied to the bypass capacitor 21.

Third Embodiment

Figure 5:
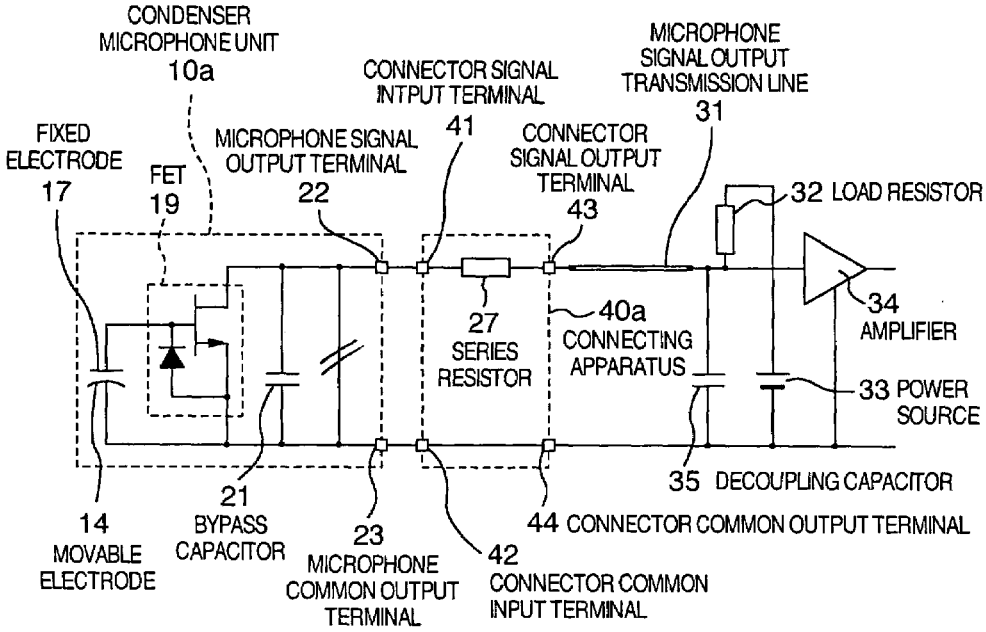
FIG. 5 is a circuit diagram of a condenser microphone unit and a connecting apparatus in the third embodiment of the invention.

FIG. 5 is a circuit diagram of a conventional condenser microphone unit and a connecting apparatus (connector) in the third embodiment of the invention. In FIG. 5, series resistor 27 is included in a connecting apparatus 40*a*. Both ends of the series resistor 27 are connected to a connector signal input terminal 41 and a connector signal output terminal 43. The microphone signal output terminal 22 and microphone common output terminal 23 of a condenser microphone unit 10*a* are connected to the connector signal input terminal 41 and a connector common input terminal 42, respectively. The connector signal output terminal 43 and a connector common output terminal 44 are connected to the microphone signal output transmission line 31 and a common terminal (ground) on a mother board of an apparatus such as a cellular phone or the like, respectively, and construct a condenser microphone apparatus for converting an acoustic signal of the cellular phone or the like into an electric signal together with the load resistor 32, power source 33, and an amplifier 34.

Since the series resistor 27 is arranged in series with the series resonance circuit comprising the microphone signal output transmission line 31 and bypass capacitor 21, the noises which are generated by the high frequency signal that is radiated or conducted from the transmitting unit of the radio apparatus can be suppressed in a manner similar to FIG. 3 of the first embodiment. In the above embodiment, since the series resistor 27 which contributes to the attenuation of the high frequency signal is provided in the connecting apparatus 40*a*, an effect similar to that of the first embodiment is derived by combining it with the condenser microphone unit 10*a*.

Fourth Embodiment

Figure 6:
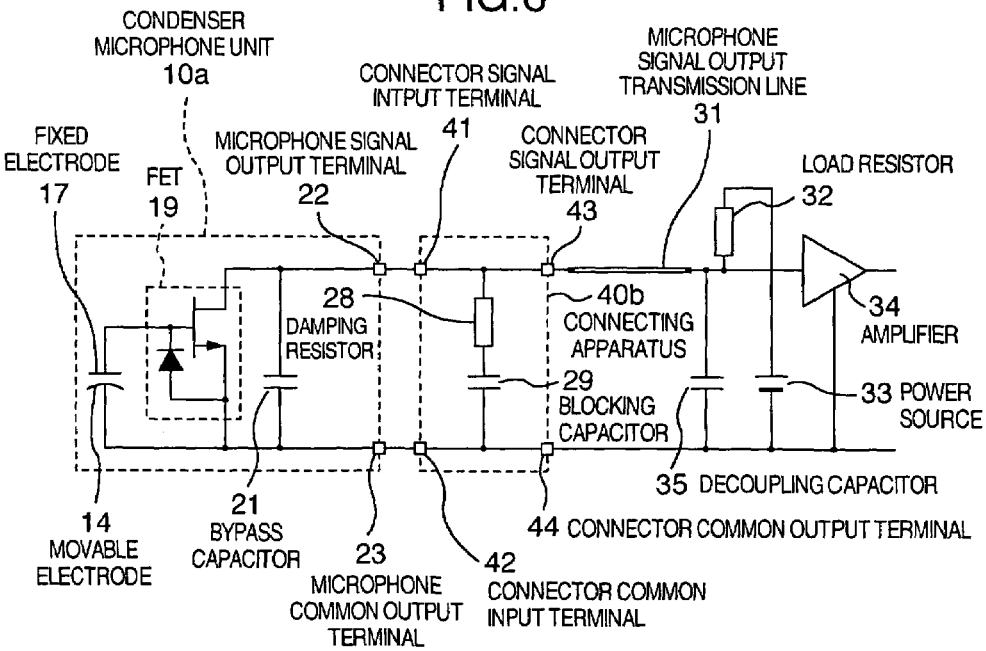
FIG. 6 is a circuit diagram of a condenser microphone unit and a connecting apparatus in the fourth embodiment of the invention.

FIG. 6 is a circuit diagram of a conventional condenser microphone unit and a connecting apparatus (connector) in the fourth embodiment of the invention. In FIG. 6, a damping resistor 28 and a blocking capacitor 29 are included in a connecting apparatus 40*b*. The damping resistor 28 and blocking capacitor 29 are serially connected and both ends of this serial circuit are connected to the connector signal input terminal 41 and connector common input terminal 42. The microphone signal output terminal 22 and microphone common output terminal 23 of the condenser microphone unit 10*a* are connected to the connector signal input terminal 41 and connector common input terminal 42, respectively. Since the damping resistor 28 and blocking capacitor 29 are arranged in parallel with the parallel resonance circuit comprising the microphone signal output transmission line 31 and bypass capacitor 21, the noises which are generated by the high frequency signal that is radiated or conducted from the transmitting unit of the radio apparatus can be suppressed in a manner similar to FIG. 4 of the second embodiment. In the above embodiment, since the damping resistor 28 and blocking capacitor 29 which contribute to the attenuation of the high frequency signal are provided in the connecting apparatus 40*b*, an effect similar to that of the second embodiment is derived by combining it with the condenser microphone unit 10*a*.

Fifth Embodiment

Figure 7:
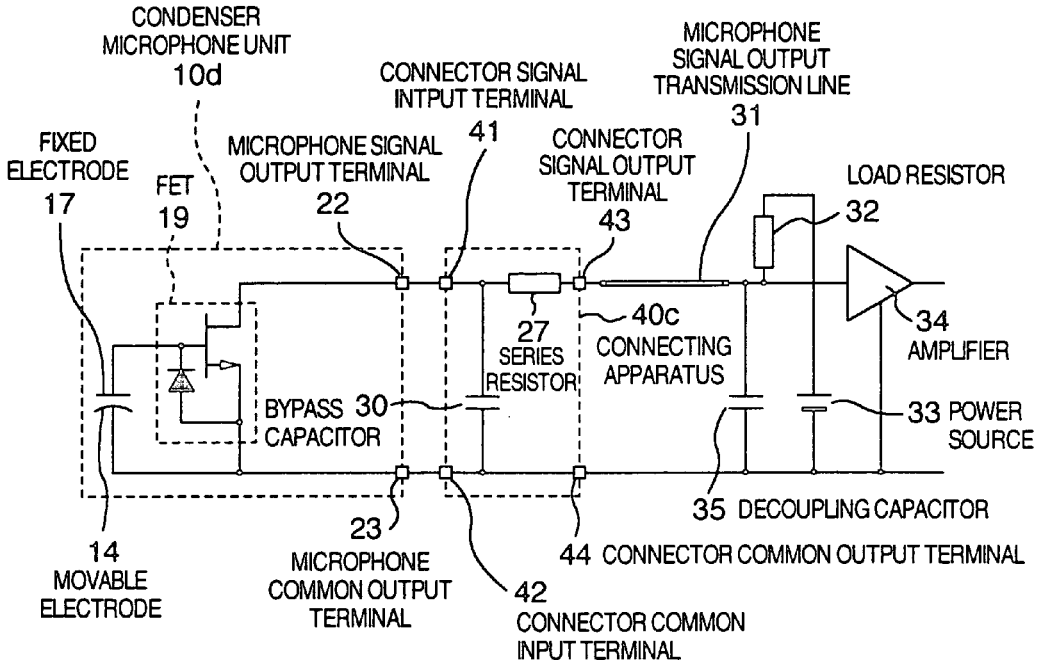
FIG. 7 is a circuit diagram of a condenser microphone unit and a connecting apparatus in the fifth embodiment of the invention.

FIG. 7 is a circuit diagram of a condenser microphone unit and a connecting apparatus (connector) in the fifth embodiment of the invention. In FIG. 7, a bypass capacitor 30 and the series resistor 27 are included in a connecting apparatus 40*c*. Both ends of the series resistor 27 are connected to the connector signal input terminal 41 and connector signal output terminal 43. Both ends of the bypass capacitor 30 are connected to the connector signal input terminal 41 and connector common input terminal 42, respectively. The microphone signal output terminal 22 and microphone common output terminal 23 of a condenser microphone unit 10*d* obtained by excluding the bypass capacitor 21 from the conventional condenser microphone unit in FIG. 2 are connected to the connector signal input terminal 41 and connector common input terminal 42, respectively.

Since the series resistor 27 is arranged in series with the series resonance circuit comprising the microphone signal output transmission line 31 and bypass capacitor 30, the noises which are generated by the high frequency signal that is radiated or conducted from the transmitting unit of the radio apparatus can be suppressed in a manner similar to FIG. 3 of the first embodiment. In the above embodiment, since the bypass capacitor 30 and series resistor 27 which contribute to the attenuation of the high frequency signal are provided in the connecting apparatus 40*c*, an effect similar to that of the first embodiment is derived by combining it with the condenser microphone unit 10*d* without a countermeasure against the high frequency noises.

Sixth Embodiment

Figure 8:
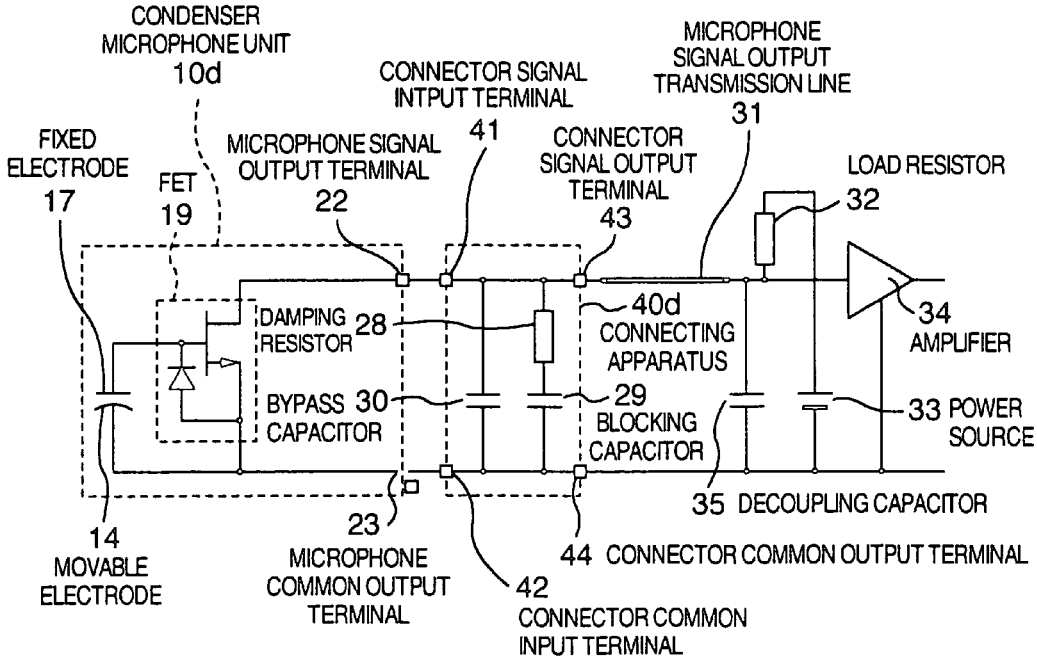
FIG. 8 is a circuit diagram of a condenser microphone unit and a connecting apparatus in the sixth embodiment of the invention.

FIG. 8 is a circuit diagram of a condenser microphone unit and a connecting apparatus (connector) in the sixth embodiment of the invention. In FIG. 8, the bypass capacitor 30, damping resistor 28, and blocking capacitor 29 are included in a connecting apparatus 40*d*. Both ends of the bypass capacitor 30 are connected to the connector signal input terminal 41 and connector common input terminal 42. The damping resistor 28 and blocking capacitor 29 are serially connected and are connected in parallel with the bypass capacitor 30. The microphone signal output terminal 22 and microphone common output terminal 23 of the condenser microphone unit 10*d* obtained by excluding the bypass capacitor 21 from the conventional condenser microphone unit in FIG. 2 are connected to the connector signal input terminal 41 and connector common input terminal 42, respectively.

Since the damping resistor 28 and blocking capacitor 29 are arranged in parallel with the parallel resonance circuit comprising the microphone signal output transmission line 31 and bypass capacitor 30, the noises which are generated by the high frequency signal that is radiated or conducted from the transmitting unit of the radio apparatus can be suppressed in a manner similar to the second embodiment. In the above embodiment, since the bypass capacitor 30, damping resistor 28, and blocking capacitor 29 which contribute to the attenuation of the high frequency signal are provided in the connecting apparatus 40*d*, an effect similar to that of the second embodiment is derived by combining it with the condenser microphone unit 10*d* without a countermeasure against the high frequency noises.

Seventh Embodiment

Figure 9:
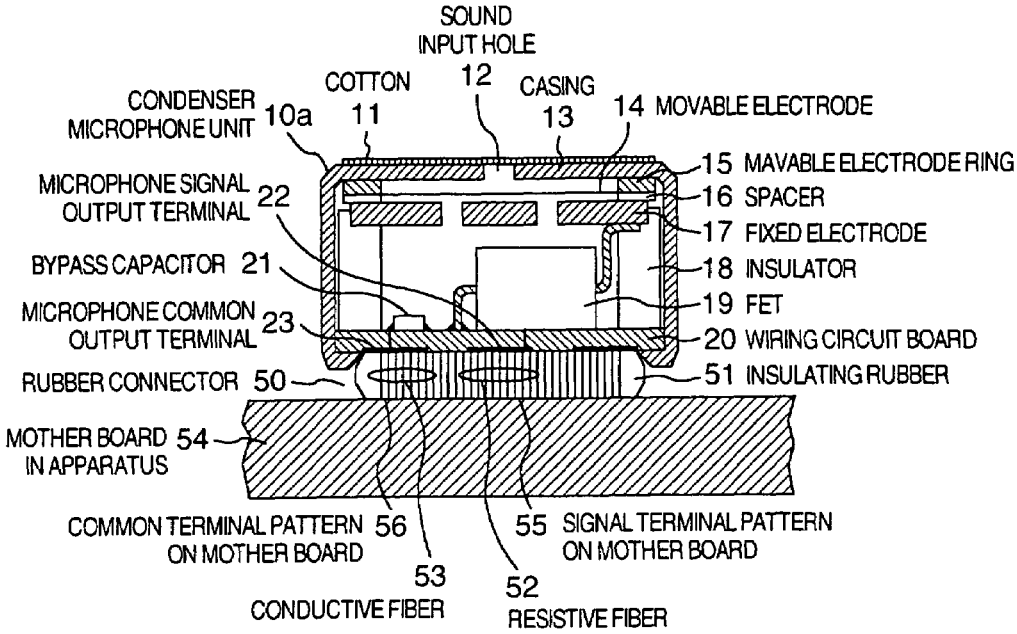
FIG. 9 is a cross sectional structural view of a condenser microphone unit and a connecting apparatus in the seventh embodiment of the invention.

FIG. 9 specifically shows the connecting apparatuses 40*a* and 40*c* in the third and fifth embodiments of the invention. In FIG. 9, a rubber connector (connecting apparatus) 50 comprises: an insulating rubber 51; a resistive fiber 52 having almost middle conductivity; and a conductive fiber 53 having high conductivity. A signal terminal pattern 55 on the mother board and a common terminal (ground terminal) pattern 56 on the mother board are constructed so as to transfer the acoustic outputs from the condenser microphone units 10*a* and 10*b* to a mother board 54 in the apparatus such as a cellular phone or the like. To certainly connect the conventional condenser microphone units 10*a* and 10*b* and the mother board 54, forces in the direction adapted to compress the rubber connector 50 from the upward and downward directions in the diagram are applied.

The resistive fiber 52 of the rubber connector (connecting apparatus) 50 is inserted into a gap between the microphone signal output terminal 22 and signal terminal pattern 55 on the mother board and enters the same connecting state as that of the series resistor 24 in FIG. 3. Therefore, even if the high frequency signal reaches from the microphone signal output transmission line (not shown) connecting to the signal terminal pattern 55, the noises which are generated due to the high frequency can be suppressed.

Although the resistive fiber 52 is substituted for the series resistor 27 in FIG. 9, for example, it can be also replaced with a conductive rubber whose volume resistance value has been adjusted.

The resistive fiber 52 can be also replaced, for example, with a circuit which is obtained by forming the damping resistor 28 and blocking capacitor 29 or the like onto a multilayer film and adhered onto the upper or lower surface of the rubber connector 50. The multilayer film comprises, for example, a conductive layer, a resistive layer, a dielectric layer, and a conductive layer, and the series resistor 27, bypass capacitor 30, blocking capacitor 29, and damping resistor 28 are formed by their forming pattern and viaholes.

The above film can be also adhered onto the wiring circuit board 20 in the first or second embodiment and a similar effect is derived in this case. By using such a film on which the resistors and capacitors are integrated, the third, fourth, fifth, and sixth embodiments other than the above embodiments can be constructed.

Eighth Embodiment

Figure 10:
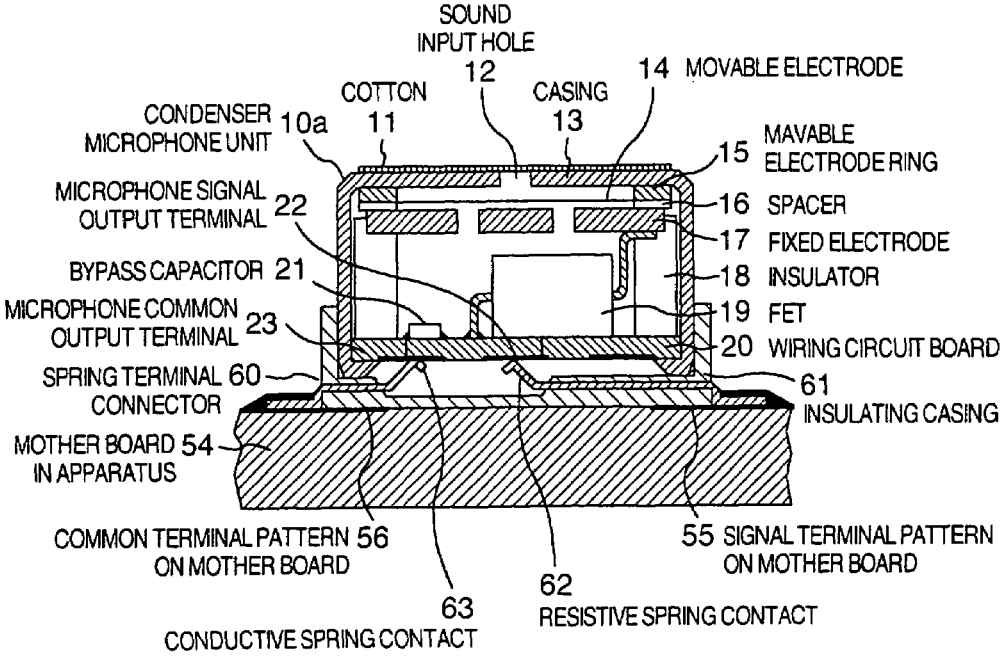
FIG. 10 is a cross sectional structural view of a condenser microphone unit and a connecting apparatus in the eighth embodiment of the invention.

FIG. 10 specifically shows the connecting terminals 40*a* and 40*c* in the third and fifth embodiments of the invention. In FIG. 10, a spring terminal connector (connecting apparatus) 60 comprises: an insulating casing 61; a resistive spring contact 62 having high resistivity; and a conductive spring contact 63 having low resistivity. The signal terminal pattern 55 on the mother board and the common terminal (ground terminal) 56 on the mother board are constructed so as to transfer the acoustic outputs from the condenser microphone units 10*a* and 10*b* to the mother board 54 in the apparatus such as a cellular phone or the like.

The resistive spring contact 62 of the spring terminal connector (connecting apparatus) 60 is inserted into the gap between the microphone signal output terminal 22 and the signal terminal pattern 55 on the mother board and enters the same connecting state as that of the series resistor 24 in FIG. 3. Therefore, even if the high frequency signal reaches from the microphone signal output transmission line (not shown) connecting to the signal terminal pattern 55, the noises which are generated due to the high frequency can be suppressed.

Although the resistive spring contact 62 is substituted for the series resistor 27 in FIG. 10, for example, a thin material having high resistivity is adhered to a conductive spring contact and the effect of the series resistor 27 can be also provided at the contact surface with the microphone signal output terminal 22.

Ninth Embodiment

Figure 1A:
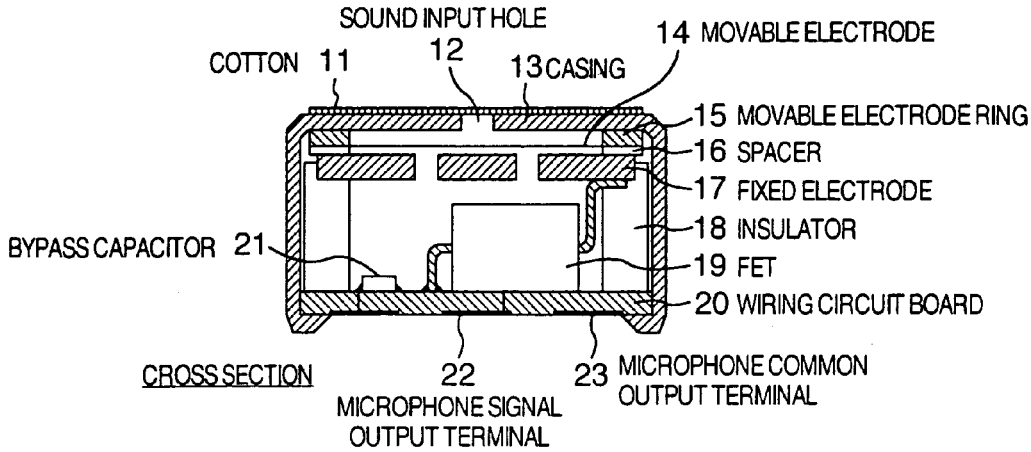
FIG.1A PRIOR ART
FIG. 1A is a cross sectional structural view showing a conventional condenser microphone apparatus.
Figure 1B:
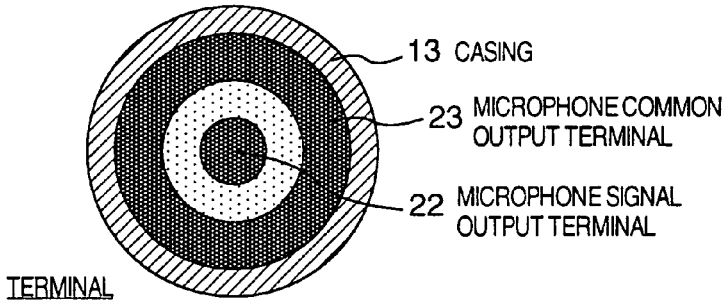
FIG.1B PRIOR ART
FIG. 1B is a diagram showing terminals of the conventional condenser microphone apparatus.
Figure 11:
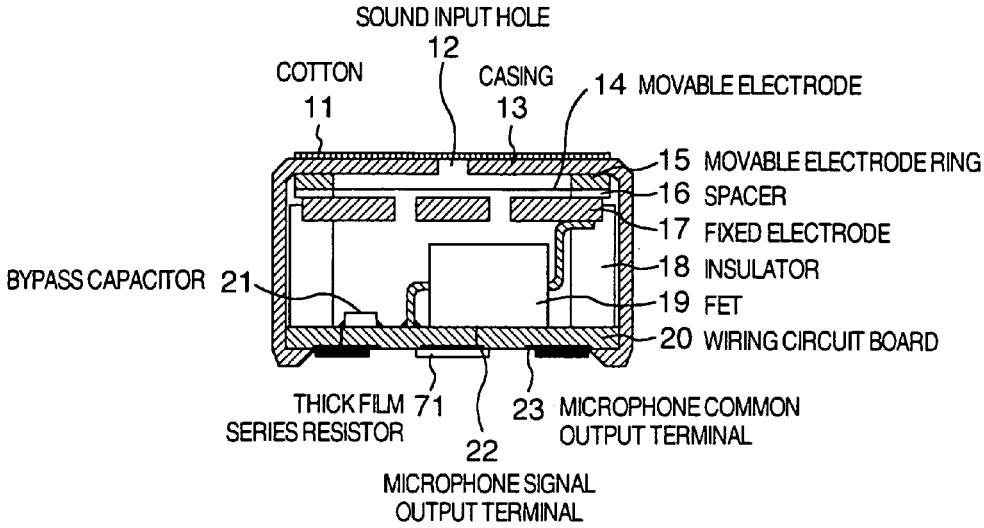
FIG. 11 is a cross sectional structural view showing a condenser microphone unit in the ninth embodiment of the invention.

FIG. 11 is a cross sectional structural view of a condenser microphone unit showing an example in which the series resistor 24 in the first embodiment of the invention is formed by coating a resistor onto the surface of the microphone signal output terminal 22 of the wiring circuit board 20. FIG. 11 differs from the cross sectional structural view of the condenser microphone unit shown in FIG. 1A with respect to a point that a thick film series resistor 71 is added. The thick film series resistor 71 is formed on the microphone signal output terminal 22 by a printing method or the like.

Since the thick film series resistor 71 is arranged in series with the series resonance circuit comprising the microphone signal output transmission line 31 and bypass capacitor 21, the noises which are generated by the high frequency signal that is radiated or conducted from the transmitting unit of the radio apparatus can be suppressed in a manner similar to the first embodiment. In the above embodiment, since the thick film series resistor 71 which contributes to the attenuation of the high frequency signal can be formed on the microphone signal output terminal 22, an effect similar to that of the first embodiment is derived merely by working a print resistor onto the wiring circuit board 20 of the conventional condenser microphone unit.

According to the condenser microphone apparatus of FIG. 11 of the ninth embodiment, although the thick film series resistor 71 has been formed on the microphone signal output terminal 22 by the printing method or the like, a similar effect is derived by another film so long as it is adhered onto the board surface by some method and has an electric resistance. For example, such a resistor can be also formed by a thin film forming step such as an evaporation deposition or the like.

Although the thick film series resistor 71 has been formed on the microphone signal output terminal 22, a similar effect is derived even when it is formed on the front surface on which the FET 19 has been installed or is formed in an inner layer of a multilayer board. In case of the former, particularly, if the resistor 71 is formed under the FET 19, since the area of the board can be effectively used in a manner similar to the latter, there is such an advantage that the other necessary parts can be installed.

Tenth Embodiment

Figure 12:
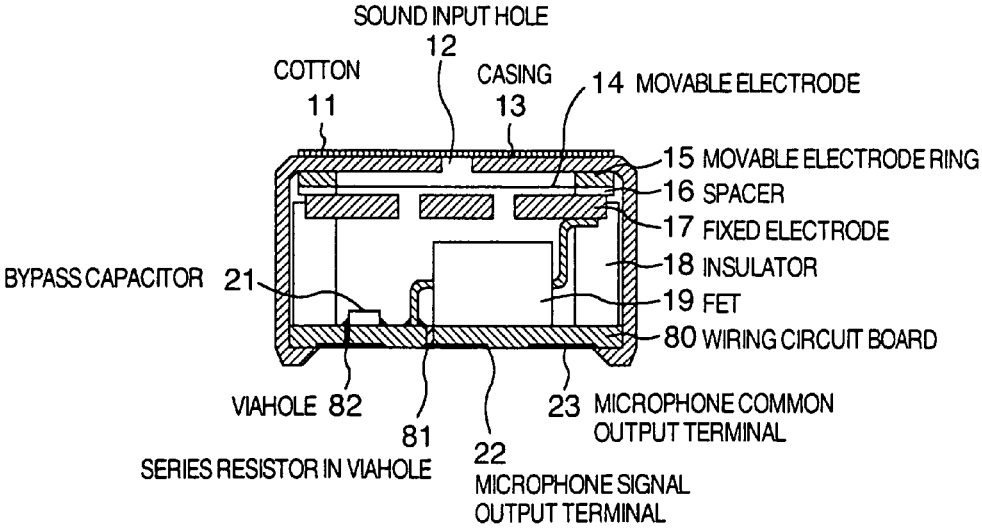
FIG. 12 is a cross sectional structural view showing a condenser microphone unit in the tenth embodiment of the invention.

FIG. 12 is a cross sectional structural view of a condenser microphone unit showing an example in which the series resistor 24 in the first embodiment of the invention is formed by filling a resistor into a viahole (through hole) 82 for electrically connecting a parts installing surface of a wiring circuit board 80 to the microphone signal output terminal 22. FIG. 12 differs from the cross sectional structural view of the conventional condenser microphone unit shown in FIG. 1A with respect to a point that a series resistor 81 in the viahole is added onto the wiring circuit board 20. The wiring circuit board 80 also seals the rear surface while wiring the circuit. A viahole directing from the drain of the FET 19 toward the microphone signal output terminal 22 and a viahole directing from the source of the FET 19 toward the microphone common output terminal 23 are formed. The former viahole has a function of the series resistor 81 in viahole in which a conductivity adjusted resistor has been filled or adhered to the side wall. The latter viahole has a function of the viahole 82 in which a material having high conductivity has been filled or plated onto the side wall.

Since the series resistor 81 in viahole is arranged in series with the series resonance circuit comprising the microphone signal output transmission line 31 and bypass capacitor 21, the noises which are generated by the high frequency signal that is radiated or conducted from the transmitting unit of the radio apparatus can be suppressed in a manner similar to the first embodiment. In the tenth embodiment, since the series resistor 81 in viahole which contributes to the attenuation of the high frequency signal can be formed in the wiring circuit board 80, an effect similar to that of the first embodiment is derived merely by changing a working method of the wiring circuit board 20 of the conventional condenser microphone unit.

In the first, third, fifth, seventh, eighth, ninth, and tenth embodiments, since the series resistor is inserted in the gap between the microphone signal output terminal 22 or microphone signal output transmission line 31 and the drain of the FET 19, even if the charges accumulated in the human body or the like are discharged and enter the apparatus such as a cellular phone or the like, the current flowing into the microphone signal output terminal 22 can be suppressed. Thus, an effect of increasing a breakdown withstanding voltage of static electricity which is applied to the condenser microphone apparatus can be obtained.

The first embodiment can be used in common with the second, fourth, or sixth embodiment. The second embodiment can be used in common with the third or fifth embodiment. The third embodiment can be used in common with the fourth or sixth embodiment. The fourth embodiment can be used in common with the fifth embodiment. The fifth embodiment can be used in common with the sixth embodiment. In this case, since the series resistor 27, damping resistor 28, and blocking capacitor 29 are simultaneously used, the effect which is obtained from each of them can be provided together. In the first to sixth embodiments, although the series resistor, damping resistor, and blocking capacitor are arranged in the condenser microphone unit or the connecting apparatus, a similar effect is derived even if they are arranged at other positions so long as electric connecting conditions are satisfied. For example, a similar effect is derived even if they are arranged at extremely close positions on the board of the cellular phone connecting the condenser microphone unit or connecting apparatus. Such a modification and an effect are also similarly applied to the bypass capacitor.

Although the series resistor in each of the first, third, fifth, and seventh to tenth embodiments has been concentratedly arranged at one position, a further large effect is derived by distributing and arranging series resistors at a plurality of positions. For example, by distributedly arranging the series resistor 24 into the condenser microphone unit **10*b* like the first embodiment, the series resistor 27 into the connecting apparatus 40*a* like the third embodiment, and further, the series resistor to the midway of the microphone signal output transmission line 31, the transmission line is divided and becomes short. Thus, the resonance frequency rises and the high frequency voltage which is applied to the FET 19 drops. Further, the transmission line 31** itself can be also made of a resistor and a similar effect is also derived. When the carrier frequency rises, a further large effect is derived.

All or a part of the bypass capacitor, series resistor, blocking capacitor, and damping resistor in the first to tenth embodiments can be installed at very close positions on the mother board of the apparatus using a condenser microphone apparatus such as a cellular phone or the like. A similar effect is derived even in this case.

Further, they can be also installed on a child board (small board) provided between the condenser microphone apparatus and the mother board and this construction is suitable in the case where the connection with the mother board of the apparatus is made by lead wires or a flexible wiring circuit board. There is also such an advantage that the other anti-static electric parts (varistor and the like) and anti-radio fault countermeasure (ceramics capacitor of a high capacitance and the like) parts can be installed here, and the like. In this case, a shape of the microphone signal output terminal of the condenser microphone apparatus is not limited to the contact type as shown in the first to tenth embodiments but another shape such as a pin terminal type or the like can be used so long as it can be installed onto the child board.

In case of distributing the series resistors in the first, third, fifth, seventh, and tenth embodiments in order to obtain the above effect, they can be distributed to not only the path of the microphone signal output terminal 22 but also the path in a range from the microphone common output terminal 23 to the ground of the mother board. In the cases of the first to tenth embodiments in which the condenser microphone unit is installed on the mother board directly or through the connecting apparatus, since the impedance of the ground potential is fairly low, as for the high frequency which is mixed, it is sufficient to pay attention to the drain of the FET 19 and bypass it to the ground side. However, in the case where the condenser microphone unit is arranged at a position away from the mother board and installed under a condition such that an area of ground pattern is small, a wiring impedance between the condenser microphone common output terminal 23 and the ground potential of the mother board is large and almost equal to an impedance of the microphone signal output transmission line. The ground (casing) potential of the condenser microphone unit is also oscillated at a high frequency. Thus, a high frequency is applied to the voltage between the drain and source of the FET 19 and noises are generated. In such a case, by separately inserting the series resistors 24 to both paths of the microphone signal output terminal 22 and microphone common output terminal 23, the high frequency voltages entering from those two paths can be reduced between the drain and source of the FET. It can be said that this state is a balanced operating state where the signal which is outputted from the condenser microphone unit is a current whose direction is opposite at the microphone signal output terminal 22 and microphone common output terminal 23 and by equalizing the high frequency potentials at the two terminals, the high frequency voltages which are applied to the microphone signal output terminal 22 and microphone common output terminal 23 are reduced. Each of the series resistors separated to both the microphone signal output terminal 22 and microphone common output terminal 23 can be further divided or the path itself can be also made of a resistor. A larger effect is derived if the resistance values of the series resistors are selected so as to equalize the magnitudes of the high frequency voltages which are generated at the microphone signal output terminal 22 and microphone common output terminal 23.

Although the FET 19 is used as buffer amplifying means in the first to tenth embodiments, a similar effect is derived even if another device, for example, an operational amplifier of an FET input is used.

Although the devices such as bypass capacitor, series resistor, damping resistor, blocking capacitor, and the like in the first to tenth embodiments are the devices of the board installing type, a similar effect is derived even if a film having an electric resistance adhered onto the board surface by some method and a structure having an electrostatic capacitance are used. For example, they can be also formed by a thin film step such as an evaporation deposition or the like. Further, as for the positions where they are formed, they can be formed on the surface where the FET 19 has been installed, on the surface where the microphone signal output terminal 22 exists, or on the inner layer of a multilayer board. A film on which they have been formed can be also adhered onto the surface such as surface on which the FET 19 has been installed, surface where the microphone signal output terminal 22 exists, or the like, or can be also arranged on the inner layer of a multilayer board.

Although the weakened high frequency voltage is applied to the drain side of the FET 19 in the first to tenth embodiments, since a relatively large high frequency voltage has been applied to the microphone signal output terminal 22, the high frequency voltage is transferred in a space in the condenser microphone unit and applied to the fixed electrode 17 of a high impedance and the gate of the FET 19. The noises which are generated due to such a cause can be reduced by providing electrostatic shields to an interval between the fixed electrode 17 and the gate of the FET 19 and to an interval between the microphone signal output terminal 22 and the series resistor 24, damping resistor 25, and bypass capacitor 21 which are connected thereto. For example, in the first embodiment, those noises can be reduced by covering the electrode and resistor of the series resistor 24 on the microphone signal output terminal 22 side by the shield layer connected to the microphone common output terminal 23 through the insulating layer. For example, in the case where the series resistor 24 is formed onto the FET 19 side of the board by a print resistor, the shield layer can be formed by covering the electrode and resistor of the series resistor 24 from the microphone signal output terminal by an insulating film (for example, resist film) and, further, covering they by a conductive layer connected to the microphone common output terminal. As a conductive layer for shielding which is used here, a thick film resistor whose resistance has been adjusted to a low resistance can be used.

Although the condenser microphone unit of the structure in which the fixed electrode 17 is distinguished from the casing 13 has been used in the first and second embodiments, another structure, for example, a structure in which the fixed electrode 17 and casing 13 are used in common can be also similarly embodied and a similar effect is also derived with this structure.

Although a system in which the charges are accumulated on the surface of the movable electrode 14 or the fixed electrode 17 has been used as a system for converting the acoustic vibration into the electric signal in the first to tenth embodiments, another system, for example, a system for supplying a bias voltage from the outside or a system for voltage-detecting an applied AC bias by a high impedance can be also embodied and a similar effect is also derived in this case.

According to the invention as mentioned above, an advantage effect such that the a noise output which is generated by a high frequency signal that is radiated or conducted from a transmitting unit of a radio apparatus can be reduced by a small number of additional parts is derived.

Even in the conventional condenser microphone unit without a countermeasure for suppressing the high frequency noises, by using a connecting apparatus having a device for suppressing the high frequency noises, the noise output can be easily reduced.

Further, an advantageous effect such that the breakdown withstanding voltage due to the static electricity is increased is derived.

The present invention is not limited to the foregoing embodiments but many modifications and variations are possible within the spirit and scope of the appended claims of the invention.

What is claimed is:

1. A condenser microphone apparatus in which a noise output due to a high frequency signal which is radiated from a transmitting unit of a radio apparatus is reduced by attenuating the high frequency signal supplied to a signal output transmission line, the condenser microphone apparatus comprising:

a movable electrode which vibrates by an acoustic vibration;

a fixed electrode arranged so as to face said movable electrode;

a field effect transistor that buffer-amplifies a voltage across said movable electrode and a voltage across said fixed electrode, said field effect transistor for providing the amplified voltage to the signal output transmission line;

a bypass capacitor in which one end is connected to a drain terminal, acting as a signal output terminal, of said field effect transistor and the other end is connected to a source terminal, acting as a common output terminal, of said field effect transistor; and a series resistor inserted at least in one of an interval between said signal output terminal of said field effect transistor and an output terminal of the apparatus and an interval between said common output terminal of said field effect transistor and a common output terminal of the apparatus, said series resistor operating in combination with said bypass capacitor for attenuating by 90% or more the voltage or current of the high frequency signal supplied to the signal output transmission line, which high frequency signal has a frequency that is equal to or higher than 800 MHz.

2. An apparatus according to claim 1, wherein at least one of said series resistor and said bypass capacitor is made of a multilayer film.

3. An apparatus according to claim 1, wherein said series resistor is formed by adhering a resistor onto a surface or an inner layer of a wiring circuit board.

4. An apparatus according to claim 1, wherein said series resistor is formed by filling a resistor into a viahole of a wiring circuit board.

5. An apparatus according to claim 1, wherein said series resistor is installed on a board provided outside of the apparatus.

6. An apparatus according to claim 1, wherein an electrostatic shield is provided at least in one of an interval between said fixed electrode and said signal output terminal of the apparatus, an interval between said fixed electrode and said bypass capacitor, and an interval between said fixed electrode and said series resistor.

7. A condenser microphone apparatus in which a noise output due to a high frequency signal which is radiated from a transmitting unit of a radio apparatus is reduced by attenuating the high frequency signal supplied to a signal output transmission line, the condenser microphone apparatus comprising:

a movable electrode which vibrates by an acoustic vibration;

a fixed electrode arranged so as to face said movable electrode;

amplifying means, comprising a field effect transistor, for buffer-amplifying a voltage across said movable electrode and said fixed electrode, said amplifying means for providing the amplified voltage to the signal output transmission line;

a bypass capacitor in which one end is connected to a drain terminal, acting as a signal output terminal, of said field effect transistor and the other end is connected to a source terminal, acting as a common output terminal, of said field effect transistor, said bypass capacitor operating to bypass a high frequency signal from an external circuit; and a serial circuit of a blocking capacitor and a damping resistor, in which one end is connected to said signal output terminal of said amplifying means and the other end is connected to the common output terminal of said amplifying means, said serial circuit operating to damp a parallel resonance of an equivalent circuit at a resonance frequency equal to or higher than 800 MHz, comprising said signal output transmission line, said bypass capacitor, and said serial circuit.

8. An apparatus according to claim 7, wherein at least one of said bypass capacitor, said damping resistor, and said blocking capacitor is made of a multilayer film.

9. An apparatus according to claim 7, wherein said damping resistor is formed by adhering a resistive material onto a surface or an inner layer of a wiring circuit board.

10. An apparatus according to claim 7, wherein said serial circuit of said blocking capacitor and said damping resistor is installed on a board provided outside of the apparatus.

11. An apparatus according to claim 7, wherein an electrostatic shield is provided at least in one of an interval between said fixed electrode and a signal output terminal of the apparatus, an interval between said fixed electrode and said blocking capacitor, and an interval between said fixed electrode and said damping resistor.

12. An apparatus according to any one of claims 7 to 11, wherein said amplifying means is constructed by a field effect transistor.

13. A system comprising a connecting apparatus connected to a connecting unit and in which a noise output due to a high frequency signal which is radiated from a transmitting unit of a radio apparatus is reduced by attenuating the high frequency signal supplied to a signal output transmission line, the system comprising:

a movable electrode which vibrates by an acoustic vibration;

a fixed electrode arranged so as to face said movable electrode;

a field effect transistor that buffer-amplifies a voltage across said movable electrode and a voltage across said fixed electrode, said field effect transistor for providing the amplified voltage to the signal output transmission line; and a bypass capacitor in which one end is connected to a drain terminal, acting as a signal output terminal, of said field effect transistor and the other end is connected to a source terminal, acting as a common output terminal, of said field effect transistor, wherein:

said connecting apparatus has a series resistor inserted at least in one of an interval between said signal output terminal of said field effect transistor and an output terminal of the apparatus and an interval between said common output terminal of said field effect transistor and a common output terminal of the apparatus, said series resistor operating in combination with said bypass capacitor for attenuating by 90% or more the voltage or current of the high frequency signal supplied to the signal output transmission line, which high frequency signal has a frequency that is equal to or higher than 800 MHz.

14. A system comprising a connecting apparatus connected to a condenser microphone unit and in which a noise output due to a high frequency signal which is radiated from a transmitting unit of a radio apparatus is reduced by attenuating the high frequency signal supplied to a signal output transmission line, the system comprising:

a movable electrode which vibrates by an acoustic vibration;

a fixed electrode arranged so as to face said movable electrode;

amplifying means, comprising a field effect transistor, for buffer-amplifying a voltage across said movable electrode and said fixed electrode, said amplifying means providing the amplified voltage to the signal output transmission line; and a bypass capacitor in which one end is connected to a drain terminal, acting as a signal output terminal, of said field effect transistor and the other end is connected to a source terminal, acting as a common output terminal, of said field effect transistor, said bypass capacitor operating to bypass a high frequency signal from an external circuit, wherein said connecting apparatus has a serial circuit of a blocking capacitor and a damping resistor, in which one end is connected to said signal output terminal of said amplifying means and the other end is connected to the common output terminal of said amplifying means, and said serial circuit operates to damp a parallel resonance of an equivalent circuit at a resonance frequency equal to or higher than 800 MHz, comprising said signal output transmission line, said bypass capacitor, and said serial circuit.

15. A system comprising a connecting apparatus connected to a condenser microphone unit and in which a noise output due to a high frequency signal which is radiated from a transmitting unit of a radio apparatus is reduced by attenuating the high frequency signal supplied to a signal output transmission line, the system comprising:

a movable electrode which vibrates by an acoustic vibration;

a fixed electrode arranged so as to face said movable electrode; and a field effect transistor that buffer amplifies a voltage across said movable electrode and a voltage across said fixed electrode, said field effect transistor for providing the amplified voltage to the signal output transmission line, wherein said connecting apparatus has a bypass capacitor in which one end in connected to a drain terminal, acting as a signal output terminal, of said field effect transistor and the other end is connected to a source terminal, acting as a common output terminal, of said field effect transistor, and a series resistor inserted at least in one of an interval between said signal output terminal of said field effect transistor and an output terminal of the apparatus and an interval between said common output terminal of said field effect transistor and a common output terminal of the apparatus, said series resistor operating in combination with said bypass capacitor for attenuating by 90% or more the voltage or current of the high frequency signal supplied to the signal output transmission line, which high frequency signal has a frequency that is equal to or higher than 800 MHz.

16. A system comprising a connecting apparatus connected to a condenser microphone unit and in which a noise output due to a high frequency signal which is radiated from a transmitting unit of a radio apparatus is reduced by attenuating the high frequency signal supplied to a signal output transmission line, the system comprising:

a movable electrode which vibrates by an acoustic vibration;

a fixed electrode arranged so as to face said movable electrode; and amplifying means, comprising a field effect transistor, for buffer-amplifying a voltage across said movable electrode and said fixed electrode, said amplifying means providing the amplified voltage to the signal output transmission line, wherein said connecting apparatus has a bypass capacitor in which one end is connected to a drain terminal, acting as a signal output terminal, of said field effect transistor and the other end is connected to a source terminal, acting as a common output terminal, of said field effect transistor, said bypass capacitor operating to bypass a high frequency signal from an external circuit, and a serial circuit of a blocking capacitor and a damping resistor, in which one end is connected to said signal output terminal of said amplifying means and the other end is connected to the common output terminal of said amplifying means, said serial circuit operating to damp a parallel resonance of an equivalent circuit at a resonance frequency equal to or higher than 800 MHz, comprising said signal output transmission line, said bypass capacitor, and said serial circuit.

17. An apparatus according to claim 13 or 15, wherein said series resistor is made of a resistive fiber or a conductive rubber.

18. An apparatus according to claim 13 or 15, wherein at least one of said series resistor and said bypass capacitor is made of a multilayer film.

19. An apparatus according to claim 14 or 16, wherein at least one of said bypass capacitor, said damping resistor, and said blocking capacitor is made of a multilayer film.

20. An apparatus according to claim 13 or 15, wherein said series resistor comprises a spring terminal connector constructed by a resistive spring material.

21. An apparatus according to claim 13 or 15, wherein said series resistor is formed by adhering a resistor onto a surface or an inner layer of a wiring circuit board.

22. An apparatus according to claim 14 or 16, wherein said damping resistor is formed by adhering a resistive material onto a surface or an inner layer of a wring circuit board.

* * * * *